United States Patent [19]

Ricardo

[11] 4,364,283

[45] Dec. 21, 1982

[54] THROTTLE CONTROL

[76] Inventor: George L. Ricardo, 3319 Clarke Blvd., Shreveport, La. 71109

[21] Appl. No.: 203,051

[22] Filed: Nov. 3, 1980

[51] Int. Cl.[3] ..... G05G 1/08; G05G 5/16

[52] U.S. Cl. ..... 74/489; 74/506; 74/531; 403/324

[58] Field of Search ..... 74/488, 489, 527, 531, 74/506; 403/324

[56] References Cited

U.S. PATENT DOCUMENTS

| | | | |
|---|---|---|---|
| 1,711,698 | 5/1919 | Shelor | 74/527 |
| 2,543,205 | 2/1951 | Shoffner | 74/527 |
| 3,982,446 | 9/1976 | Van Dyken | 74/531 X |
| 4,137,793 | 2/1979 | Sowell | 74/531 X |

FOREIGN PATENT DOCUMENTS

| | | | |
|---|---|---|---|
| 1077007 | 4/1954 | France | 74/527 |
| 127460 | 4/1947 | Sweden | 74/527 |

*Primary Examiner*—Allan D. Herrmann

[57] ABSTRACT

A throttle control for use with a return-biased throttle system in a motorcycle or similar vehicle, which includes a cam lever fitted with a cam body having a slidably mounted, spring-loaded internal plunger, which cam body is mounted in the motorcycle throttle housing with one end of the plunger in close proximity to the throttle cable drum and designed to bias against the cable drum and maintain the cable drum and throttle grip in fixed position upon manipulation of the cam lever.

10 Claims, 8 Drawing Figures

THROTTLE CONTROL

BACKGROUND OF THE INVENTION

1. Field of the Invention

This invention relates to a throttle control apparatus for motorcycles and similar vehicles, and more particularly, to a cam lever motorcycle throttle control which is mounted in the vehicle throttle housing and is designed to bias the throttle cable drum and the throttle handle or grip attached to the cable drum in a selected throttle position or setting as the motorcycle is operated. The conventional motorcycle twist grip throttle is designed to control the speed of the engine by means of a cable or cables enclosed in a cooperating conduit or conduits, one end of which cable is attached to the engine carburetor linkage and the other end to a cable drum which cooperates with a twist grip handle or throttle mounted on the handle bars of the vehicle. The throttle handle is biased toward a preselected idle speed by the spring mounted on the carburetor end of the cable. As the throttle is twisted in the counter-clockwise direction (as viewed by the rider) against the bias of the spring the cable is wound on the cable drum and is displaced inside the cable conduit, and the engine is caused to operate at a higher rpm. In many cases, and particularly on long trips where a relatively constant throttle setting is desired in order to maintain a particular speed of travel, it is desirable to maintain the throttle in position at a selected carburetor setting. It is also desirable to maintain this selected speed setting by mechanical means in order to rest the muscles of the hand and arm. In addition to functioning as a throttle immobilizing device, the mechanical mechanism employed to maintain a selected throttle setting must also be easily susceptible of manual override in the event of emergency, it should not interfere with the carburetor cable spring in returning the throttle to idle speed position when the device is positioned in the "off" configuration, and it must be simply designed and easy to manipulate, as well as conveniently located on or near the handle bars of the vehicle.

2. Description of the Prior Art

Since hand grip throttles on motorcycles and similar vehicles are spring-biased to return to the idle speed condition when the operator's hand is released, most of the prior art devices designed to maintain a specified throttle speed setting are designed to counteract the bias of this spring. One such device is disclosed in U.S. Pat. No. 4,060,008 to Jerome Wilkinson, which device includes a pair of elongated members hinged at one end and having arcuate surfaces adapted to contact the throttle control member or grip, with an O-ring or other biasing member such as a rubber band attached to the opposite end to hold the throttle grip at a selected speed setting. Another throttle control device for motorcycles is disclosed in U.S. Pat. No. 3,982,446 to Andrew Van Dyken, which device includes a slip ring slidably fitted around the outer periphery of a collar, the latter of which is fastened to the rotatable hand grip throttle control. The slip ring is designed to selectively tighten around the collar and throttle grip to maintain the throttle grip at a selected speed setting according to the desires of the rider. Another throttle control device for motorcycles is disclosed in U.S. Pat. No. 4,137,793 to William E. Sowell, which device includes a clamping arrangement mounted over the rotatable sleeve of a throttle control device in the motorcycle, and provided with a tab that engages conventional equipment mounted on the handle bars to selectively prevent rotation of the throttle at certain speed settings selected by the rider.

Many of the prior art throttle control devices for motorcycles are disadvantageous, in that they are cumbersome and unwieldy, and sometimes prove to be difficult to mount on the handle bars and throttle mechanism assembly of the vehicle. Furthermore, some of these prior art mechanisms do not easily allow the throttle to return to the original, preset idle position when they are released, a factor which can be dangerous in the operation of such speed control devices. Such devices must perform basically three functions in order to be effective in maintaining a safe engine throttle setting during operation of a motorcycle or similar vehicle; first, the device must be simple, easy to manipulate and control, and it must operate in a positive manner to hold a desired engine throttle setting. Secondly, the throttle control mechanism must be quickly and easily susceptible of manual override in the event of an emergency without the necessity of tripping the engaging and disengaging mechanism to achieve the override condition. Third, the device should operate to completely disengage from contact with the throttle cable drum or sleeve when disengaged to allow the throttle to return to the idle position by operation of the carburetor spring.

Accordingly, it is an object of this invention to provide a new and improved throttle control which is characterized by a cam lever pivotally mounted in a threaded cam lever body, which body is threadably inserted in a tapped aperture in the throttle housing of a motorcycle or similar vehicle, with a spring-biased cam lever plunger in contact with the motorcycle housing cable drum attached to the vehicle throttle grip, to selectively bias the cable drum and grip at a selected desired throttle setting by initially rotating the throttle grip to a desired engine speed setting and vehicle speed, and subsequently manipulating the cam lever.

Another object of this invention is to provide a new and improved cam lever-actuated throttle control device for motorcycles and similar vehicles, which device performs the function of positively maintaining substantially any desired engine throttle position by simple manipulation of the cam lever, and yet facilitates a quick and easy manual override without the necessity of disengaging the device in an emergency situation.

A still further object of the invention is to provide a motorcycle and similar vehicle throttle control device which includes a cam lever and a cooperating threaded cam lever body, which body is threadably inserted in the throttle housing of a motorcycle with the spring-biased cam lever plunger in selective contact with the vehicle cable drum to effect positive, yet quickly releasable speed control of the motorcycle.

Yet another object of this invention is to provide a new and improved cam lever-operated throttle control device for motorcycles and similar vehicles, which device can be quickly and easily installed on the vehicle by drilling a hole in the motorcycle throttle housing, tapping the hole to receive the threads of the cam lever body, and threadably attaching the cam lever body and cam lever to the throttle housing for selective engagement of the internally spring-biased cam lever plunger with the rotatable cable drum attached to the vehicle throttle grip to achieve a positive, yet easily overridden speed control of the motorcycle.

Still another object of the invention is to provide a new and improved throttle control for motorcycles which includes a cam lever mechanism having a spring biased plunger adapted to contact the motorcycle cable drum to immobilize the drum at a selected carburetor speed setting and withdraw from the cable drum to allow the throttle to respond to the throttle spring and return to idle speed.

SUMMARY OF THE INVENTION

These and other objects of the invention are provided in a device for temporarily maintaining the throttle setting of a motorcycle or similar vehicle for a selected period of time, which device includes a cam lever and a cooperating threaded cam lever body which is threadably mounted in the throttle housing of a motorcycle with the internally biased cam plunger in selective contact with the throttle cable drum of the motorcycle. The cam plunger operates to position the throttle cable drum and grip at a desired throttle setting by manipulating the cam lever. The cam lever throttle control can be easily overriden by simply manually rotating the throttle grip to achieve instant override without the necessity of manipulating the cam lever to disengage the cruise control device.

BRIEF DESCRIPTION OF THE DRAWING

The invention will be better understood by reference to the accompanying drawing wherein.

DESCRIPTION OF THE PREFERRED EMBODIMENTS

Figure 1:
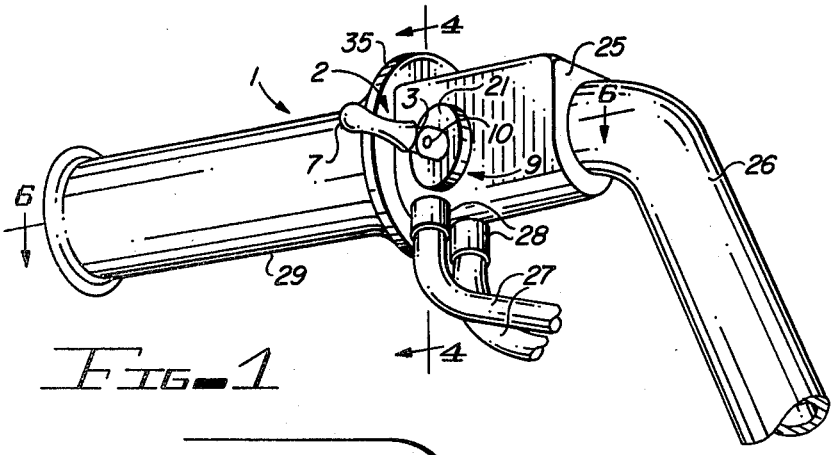
FIG. 1 is a perspective view of a motorcycle throttle and throttle housing with the motorcycle throttle control device of this invention mounted thereon.
Figure 4:
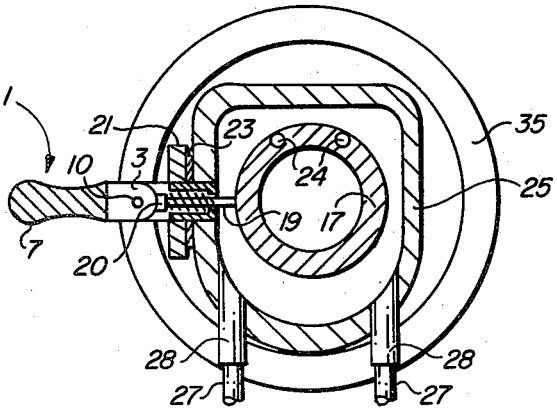
FIG. 4 is a sectional view taken along lines 4—4 in FIG. 1, illustrating the throttle control device in functional, activated position.
Figure 5:
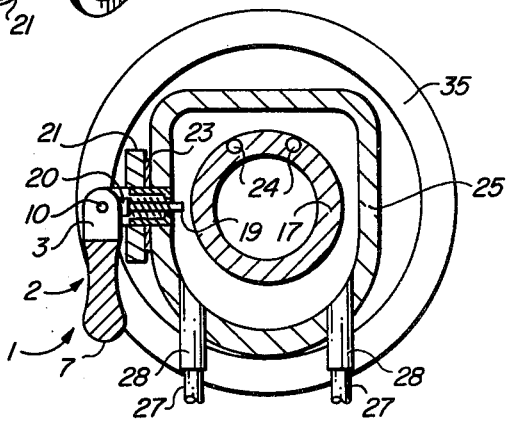
FIG. 5 is a sectional view also along lines 4—4 in FIG. 1, illustrating the throttle control in non-functional deactivated configuration.
Figure 6:
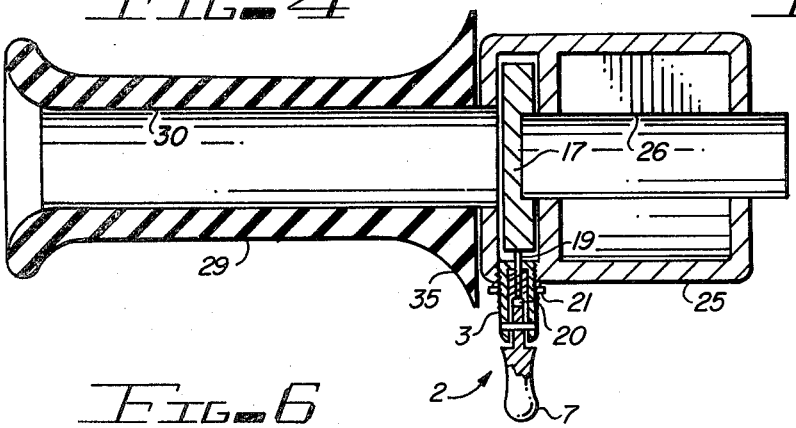
FIG. 6 is a sectional view taken along lines 6—6 in FIG. 1, again illustrating the motorcycle throttle control in functional, activated configuration.

Referring now to FIG. 1 of the drawing, the throttle control device of this invention is generally illustrated by reference numeral 1, and is illustrated in functional position mounted on the conventional throttle housing 25 of a motorcycle or similar vehicle. Throttle control 1 includes a cam lever 2, which is pivotally mounted on a stationary cam lever body 9 by means of a pin 10, as illustrated. Cam lever body 9 is threadibly attached to throttle housing 25 as hereinafter described, and is tightly secured to the throttle housing 25 by means of a lock nut 21. The throttle housing 25 is securely mounted on the right hand handle bar 26 of the motorcycle, and as illustrated in FIG. 6, a conventional throttle grip 29, with grip flange 35, is carried by cable drum sleeve 30, terminating in cable drum 17, and is rotatably positioned in housing 25. A pair of throttle cables [not illustrated] are contained in conventional throttle cable conduits 27, attached to throttle housing 25 by means of cable conduit fittings 28, and are secured in cable seats 24 and carried by cable drum 17, as shown in FIGS. 4 and 5 . Accordingly, rotation of throttle grip 29 in the counter-clockwise direction causes the throttle cables to slide inside cable conduit fittings 28 and selectively open and close the carburetor against the bias of the throttle spring [not illustrated] which is conventionally attached to the opposite end of the throttle cables and to the carburetor. Advancement of the throttle grip 29 in a counter-clockwise direction as viewed by the rider causes the engine to accelerate and the motorcycle to gain speed. While a throttle housing 25 which is designed to receive a pair of throttle cables is illustrated, it will be appreciated that the throttle control 1 of this invention can also be used with single cable systems.

Figure 8:
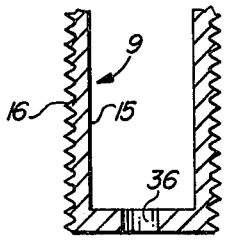
FIG. 8 is an enlargement of the lower segment of the cam lever body in the sectional view of FIGS. 4 and 5, illustrating a counter bore feature.
Figure 2:
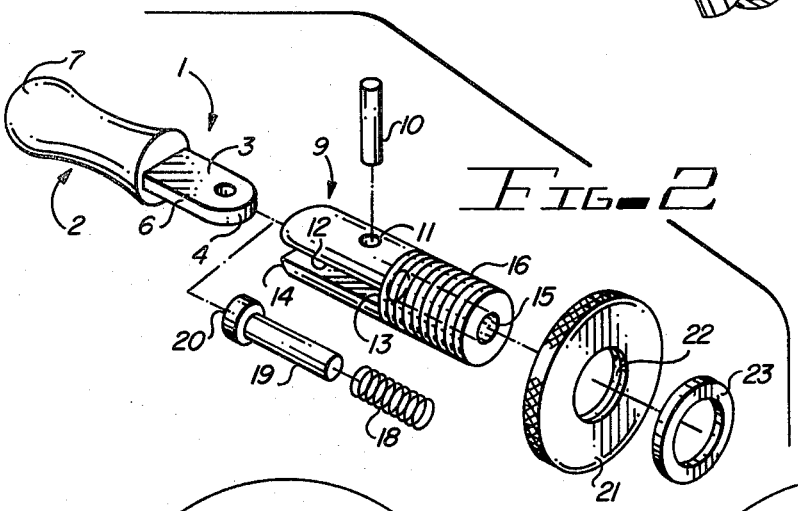
FIG. 2 is an exploded view of the motorcycle throttle control illustrated in FIG. 1.
Figure 3:
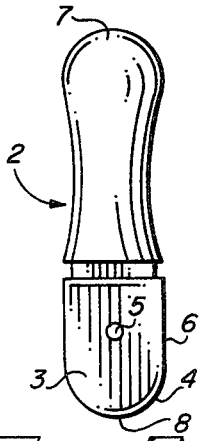
FIG. 3 is a side elevation of a cam lever in the motorcycle throttle control device.

Referring now to FIGS. 2, 3 and 8 of the drawing in a preferred embodiment of the invention the cam lever 2 of throttle control 1 includes a projecting cam lever base 3 having a shaped base radius 4 and a flat portion or plunger cap seat 8 in the center thereof, as is more particularly illustrated in FIG. 3. Cam lever 2 is further provided with a base aperture 5 to receive an expansion pin 10 for the purpose of mounting cam lever 2 on the cam lever body 9. Cam lever base 3 is further configured to shape opposite face edges 6, and a toggle 7, the latter of which can be easily manipulated by the finger or thumb during operation of the motorcycle. Cam lever body 9 is further provided with a pin aperture 11 for receiving pin 10 as described above, and also includes a body slot 12, for registration with the cam lever base 3 of cam lever 2, as illustrated in FIG. 2. Body slot 12 of cam lever body 9 further defines a flat slot base 13, the surface of which is in transverse relationship to the extending body flanges 14, and a counter-bored spring aperture 15 is provided in slot base 13 and extends almost through the entire length of cam lever body 9. As illustrated in FIG. 8, a plunger bore 36 is provided in the bottom of cam lever body 9 at the termination of the counter-bored spring aperture 15. While cam lever body 9 can be mounted in throttle housing 25 by substantially any means, in a preferred embodiment of the invention cam lever body threads 16 are provided on the exterior of cam lever body 9 below body flanges 14 for threadibly receiving the lock nut threads 22 of a cooperating lock nut 21 for adjustably mounting throttle control 1 in throttle housing 25. A plunger spring 18 and cooperating plunger 19, provided with a plunger cap 20, are inserted in spring aperture 15 with the end of plunger 19 opposite plunger cap 20 extending through the entire length of spring aperture 15, and projecting through plunger bore 36 in the bottom end of cam lever body 9. An O-ring or rubber washer 23 serves to seal lock nut 21 tightly against throttle housing 25, as illustrated in FIGS. 1 and 2.

Referring now to FIGS. 4 and 5 of the drawing, and initially to FIG. 4 when throttle control 1 is in functional, activated position, toggle 7 of cam lever 2 is manipulated to a position in alignment with cam lever body 9, as illustrated. When cam lever 2 is in this position, base radius 4 and plunger cap seat 8 contact plunger cap 20 of plunger 19 and force the plunger 19 against the cable drum 17, which is attached to throttle grip 29, and is rotatably mounted on handle bar 26. Accordingly, cable drum 17 and the attached throttle grip 29 are maintained at a selected throttle setting or position by contact between the end of plunger 19 and cable drum 17 when throttle control 1 is engaged. Referring to FIG. 5, the throttle control 1 is illustrated in disengaged configuration with the toggle 7 of cam lever 2 rotated downwardly on pin 10 with respect to cam lever body 9. This configuration of throttle control 1 releases the bias of plunger spring 18 and allows the end of plunger 19 to withdraw from contact with cable drum 17 to permit cable drum 17 and throttle grip 29 to again rotate freely responsive to the driver's hand or to the carburetor spring. The movement of plunger 19 toward cam lever 2 when toggle 7 is rotated is facilitated since the distance between pin 10 and each of the base edges 6 is less than the distance between pin 10 and the plunger cap seat 8 on cam lever base 3. It will be appreciated from a further consideration of FIGS. 4 and 5 that throttle control 1 can be quickly and easily disengaged from the position shown in FIG. 4 to the configuration illustrated in FIG. 5 by maneuvering toggle 7 either upwardly or downwardly as illustrated, or in any disengaged position in order to achieve the desired withdrawal of plunger 19 from cable drum 17.

Referring to FIG. 6 of the drawing the throttle control 1 of this invention is again illustrated in functional, engaged position as mounted on throttle housing 25 with the end of plunger 19 in contact with cable drum 17, as previously described with respect to FIG. 4. The capability of free rotation of throttle grip 29 and cable drum 17 with respect to handle bar 26 is also shown. It will be appreciated from a consideration of FIG. 6 that the toggle 7 can be quickly and easily engaged and disengaged by using the finger or thumb of one hand as throttle grip 29 is manipulated to maintain a selected motorcycle speed.

Figure 7:
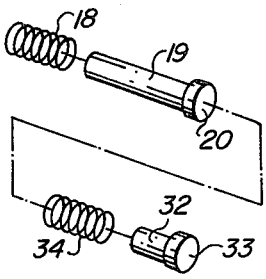
FIG. 7 is a perspective view of an alternative internal plunger and spring mechanism for the throttle control cam lever.

Referring to FIGS. 7 and 8 of the drawing, in another preferred embodiment of the invention the internal mechanism of throttle control 1 includes a shorter plunger spring 18 and plunger 19 than the counterparts illustrated in FIG. 2, which components are both inserted in spring aperture 15 as heretofore described. Additionally, a cam follower spring 34 and a cooperating cam follower 32, having a cam follower cap 33, are inserted in spring aperture 15 in stacked relationship to plunger 19 and plunger spring 18, with the end of plunger 19 projecting from plunger bore 36. This mechanical arrangement has proved effective to enhance the override characteristics by lessening the rigidity of the single-plunger mechanism. However, in a most perferred embodiment of the invention a single plunger spring 18 and plunger 19 is provided in spring aperture 15 in order to cause pressure to be exerted against cable drum 17.

In operation, the throttle control 1 of this invention is used by initially attaining a desired vhicle speed by manipulating throttle grip 29 in conventional fashion with the toggle 7 and cam lever 2 in either the upright or downward position with respect to the cam lever body 9, as illustrated in FIG. 5 of the drawing, and plunger 19 therefore disengaged from cable drum 17. When a desired cruising speed is reached, toggle 7 is manipulated to the position illustrated in FIGS. 4 and 6 in alignment with cam lever body 9, a maneuver which causes the base radius 4 and plunger cap seat 8 of cam lever base 3 to rotate against plunger cap 20 of plunger 19, and force the opposite end of plunger 19 against cable drum 17 to secure cable drum 17 and throttle grip 29 in the desired position. It will be appreciated by those skilled in the art that while cable drum 17 and throttle grip 29 are securely maintained in this preselected position by plunger 19, throttle grip 29 may be quickly and easily adjusted at any time to override throttle control 1 in the event of an emergency. However, when it is desired to release the throttle control 1 from the activated configuration as illustrated in FIGS. 4 and 6, under ordinary circumstances, toggle 7 is simply manipulated downwardly or upwardly as illustrated in FIG. 5 to release the end of plunger 19 from contact with cable drum 17.

It will be appreciated that cam lever 2 and cam lever body 9 can be shaped from substantially any non-corrosive material such as aluminum, stainless steel, or plastic, and plunger 19 is formed of a suitable plastic or nylon material, according to the knowledge of those skilled in the art. Plunger spring 18 is most preferably formed of stainless steel in order to insure long life and reliable operation under a variety of weather conditions. Furthermore, referring again to FIGS. 4–6, lock nut 21 can be threadably adjusted on cam lever body threads 16 to alter the distance between plunger 19 and cable drum 17, in order to insure that sufficient pressure is applied against cable drum 17 to immobilize it and throttle grip 29.

It will also be appreciated that throttle control 1 can be mounted at any point on throttle housing 25 which allows plunger 19 to contact the cable drum 17 without interfering with the position of the cable or cables or other accessory equipment.

Having described my invention with the particularity set forth above, what is claimed is:

1. A throttle control for motorcycles and similar vehicles having a cable drum comprising:

(a) a generally cylindrically-shaped cam lever body, an aperture and a counter-bore extending through the longitudinal center of said cam lever body, and a slot in one end of said cam lever body, said slot defining a pair of oppositely disposed flanges;

(b) bias means fitted in said counter-bore of said cam lever body and plunger means cooperating with said bias means and extending through said aperture and said counter-bore of said cam lever body, with one end of said plunger means projecting from said aperture through said counter-bore into said slot and the opposite end of said plunger means projecting from said cam lever body into selective contact with the cable drum; and (c) a cam lever having a cam lever base, said cam lever base in registration with said slot and pivotally carried by said flanges of said cam lever body for selectively effecting contact between said cam lever base and the end of said plunger means projecting into said slot, and displacing said plunger means in said aperture in said cam lever body and selectively against the cable drum responsive to manipulation of said cam lever from a position substantially transverse to said cam lever body to a position in alignment with said cam lever body.

2. The throttle control of claim 1 further comprising external threads on a portion of said cam lever body and a lock nut having internal lock nut threads for threadable cooperation with said external threads of said cam lever body and mounting said throttle control in the throttle housing of said motorcycle.

3. The throttle control of claim 1 wherein said bias means is a coil spring and said plunger means is a single plunger positioned inside said coil spring and having a plunger cap on said end of said plunger means projecting into said slot for contact with said cam lever base.

4. The throttle control of claim 1 wherein said bias means is a first coil spring carrying said plunger means in concentric relationship in said counter-bore and said aperture, respectively, and a second coil spring positioned in said counter-bore and in alignment with said first coil spring, and further comprising cam follower means carried by said second coil spring in concentric relationship and positioned in substantial alignment with said plunger means, said cam follower means having a cam follower cap projecting into said slot for contact with said cam lever base.

5. The throttle control of claim 1 wherein said bias means is a coil spring and said plunger means is a single plunger positioned inside said coil spring and having a plunger cap on said one end of said plunger means projecting into said slot for contact with said cam lever base, and further comprising external threads on a portion of said cam lever body and a lock nut having internal lock nut threads for threadable cooperation with said external threads of said cam lever body and mounting said throttle control in the throttle housing of said motorcycle.

6. The throttle control of claim 1 wherein the projecting end of said cam lever base is rounded to a radius and includes a flat cap seat in the center of said radius for contacting said plunger means and depressing said plunger means against said bias means and stabilizing said cam lever when said cam lever is manipulated in alignment with said cam lever body.

7. The throttle control of claim 1 wherein:

(a) said bias means is a coil spring and said plunger means is a single plunger positioned inside said coil spring and having a plunger cap on said end of said plunger means projecting into said slot for contact with said cam lever base; and (b) the projecting end of said cam lever base is rounded to a radius and includes a flat cap seat in the center of said radius for contacting said plunger cap and depressing said plunger against said spring and stabilizing said cam lever when said cam lever is manipulated in alignment with said cam lever body.

8. The throttle control of claim 7 further comprising external threads on a portion of said cam lever body and a lock nut having internal lock nut threads for threadable cooperation with said external threads of said cam lever body and mounting said throttle control in the throttle housing of said motorcycle.

9. The throttle control of claim 1 wherein:

(a) said bias means is a first coil spring carrying said plunger means in concentric relationship in said counter-bore and said aperture, respectively, and a second coil spring positioned in said counter-bore and in alignment with said first coil spring, and further comprising cam follower means carried by said second coil spring in concentric relationship and positioned in substantial alignment with said plunger means, said cam follower means having a cam follower cap projecting into said slot for contact with said cam lever base, and (b) the projecting end of said cam lever base is rounded to a radius and includes a flat cap seat in the center of said radius for contacting said cam follower cap and depressing said cam follower against said second coil spring and said plunger against said first coil spring and stabilizing said cam lever when said cam lever is manipulated in alignment with said cam lever body.

10. The throttle control of claim 9 further comprising external threads on a portion of said cam lever body and a lock nut having internal lock nut threads for threadable cooperation with said external threads of said cam lever body and mounting said throttle control in the throttle housing of said motorcycle.

* * * * *